US006211124B1

(12) United States Patent
Ormerod, IV et al.

(10) Patent No.: US 6,211,124 B1
(45) Date of Patent: Apr. 3, 2001

(54) NON-FOAMING LIQUID HARD SURFACE DETERGENT COMPOSITIONS

(75) Inventors: Raleigh Clair Ormerod, IV, Watertown, MA (US); Arnold George Benecke, Indian Springs; Donald Roy Meece, Norwood, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 08/959,974

(22) Filed: Oct. 29, 1997

Related U.S. Application Data

(60) Provisional application No. 60/029,507, filed on Oct. 29, 1996.

(51) Int. Cl.[7] ..... C11D 1/94; C11D 3/37; C11D 3/43; C11D 17/04

(52) U.S. Cl. ..... 510/108; 510/238; 510/406; 510/422; 510/424; 510/470; 510/494; 510/504

(58) Field of Search ..... 510/108, 238, 510/504, 406, 422, 424, 470, 494

(56) References Cited

U.S. PATENT DOCUMENTS

| | | | | |
|---|---|---|---|---|
| 5,055,219 | * | 10/1991 | Smith | 510/195 |
| 5,232,632 | * | 8/1993 | Woo et al. | 510/406 |
| 5,236,614 | * | 8/1993 | Jacquet et al. | 510/214 |
| 5,336,426 | * | 8/1994 | Rader et al. | 510/195 |
| 5,462,689 | * | 10/1995 | Choy et al. | 510/373 |
| 5,639,722 | * | 6/1997 | Kong et al. | 510/191 |

* cited by examiner

*Primary Examiner*—Lorna M. Douyon
(74) *Attorney, Agent, or Firm*—Jason J. Camp

(57) ABSTRACT

Very slightly thickened, shear-thinning, pseudoplastic liquid detergent compositions are packaged in a non-aerosol spray delivery package specifically configured to produce a minimal amount of visible foam along with a minimal amount of small particles that may cause consumer discomfort and preferably comprise a mixture of nonionic and zwitterionic detergent surfactants; hydrophobic cleaning solvent; and polycarboxylate detergent builder to provide superior cleaning of all of the soils commonly found in the bathroom. The compositions preferably have a pH of from about 1 to about 13, preferably to about 5.5. The compositions are in the form of aqueous liquids.

22 Claims, 1 Drawing Sheet

NON-FOAMING LIQUID HARD SURFACE DETERGENT COMPOSITIONS

CROSS REFERENCE

This application claims priority under Title 35, United States Code 119(e) from Provisional Application Ser. No. 60/029,507, filed Oct. 29, 1996.

FIELD OF THE INVENTION

This invention pertains to non-aerosol, non-foaming liquid detergent compositions that are safe and which tend to stick on vertical surfaces even when used (dispensed) without foaming. They are used for cleaning hard surfaces and especially are acidic liquid detergent compositions for bathrooms. Such compositions typically contain detergent surfactants, and, optionally, detergent builders and/or solvents to accomplish their cleaning tasks.

BACKGROUND OF THE INVENTION

The use of cleaning compositions containing organic water-soluble synthetic detergents, and, optionally, solvents, and/or detergent builders to produce foams for, e.g., bathroom cleaning tasks is known. Such compositions, are convenient, especially in the ease of application, the effectiveness of cleaning vertical surfaces, and in safety. Typical "sprayer" packages create a pattern of fine droplets of liquid and although they are more economical, provide good coverage with only minimal physical effort on the part of the consumer, and are preferred by many users, they can produce significant irritation to nose, throat, and lungs because of many small particles that become aerosolized and they can run down vertical surfaces. Non-foaming sprays are typically non-acidic formulas which show irritation when aerosolized by the typical sprayer. An object of the invention is to provide detergent compositions in conventional liquid sprayers, especially trigger-type sprayers of the type disclosed herein configured specially to provide a spray, with negligible effort, that minimizes the small particles that contribute significantly to nose and throat discomfort without appreciable loss of coverage and without a visible foam on the surface. The preferred acidic compositions provide good cleaning for all of the usual hard surface cleaning tasks found in the bathroom including removal of hard-to-remove soap scum and hard water deposits.

SUMMARY OF THE INVENTION

This invention relates to an article of manufacture comprising slightly thickened, shear-thinning, pseudo plastic liquid detergent compositions having a viscosity, as disclosed hereinafter, in the range of from about 0 to about 30 cps, preferably less than about 25 cps, packaged in a non-aerosol spray package, said compositions being dispensed without a visible foam, e.g., a foam/liquid volume ratio of less than about 2/1, preferably less than about 1.8/1, and even more preferably ≦about 1.7/1, when dispensed from said spray device "spray means," as described hereinafter, but with a lowered content, e.g., less than about 4 $mg/m^3$, preferably less than about 3.5 $mg/m^3$, more preferably less than about 3 $mg/m^3$, of particles that have a diameter of less than about 10 microns. This invention also relates to said compositions, preferably those having a pH of from about 1 to about 13, more preferably from about 1 to about 5.5. The use of a very slightly thickened formula is especially effective for improving cling and even coverage on vertical surfaces where very thin liquids tend to drip and can clean unevenly.

More specifically, the invention relates to an aqueous, acidic hard surface detergent composition comprising: (a) detergent surfactant, preferably a mixture of nonionic and zwitterionic detergent surfactants; (b) optional, but preferred, hydrophobic solvent that provides a primary cleaning function; (c) optional, but preferred, polycarboxylate detergent builder; and (d) polymeric, shear-thinning thickener to raise the viscosity of said composition to no more than from about 0 to about 30 cps, preferably less than about 25 cps, said composition having a pH of from about 1 to about 5.5. These preferred compositions can also contain an optional buffering system to maintain the acidic pH and the balance typically being an aqueous solvent system and minor ingredients.

The compositions, including the preferred compositions, are typically formulated at usage concentrations and packaged in a container having "spray means" (hereinbefore and hereinafter "spray package"), to make application to hard surfaces more convenient. The compositions can also be formulated as concentrates that can be diluted to usage concentrations in spray packages.

BRIEF DESCRIPTION OF THE DRAWING

"The FIGURE" is composed of FIG. 1 which is a cross section of a typical spray nozzle 3 herein and FIG. 2 which is a top view of a typical "swirl chamber" 5 of such a spray nozzle 3. The portions of the nozzle 3 are referenced hereinafter by letters which are defined as follows: the orifice diameter (O), shown as reference number 8 in FIG. 1; the orifice land length (L), shown as reference number 9 in FIG. 1; the swirl chamber depth (D), shown as reference number 7 in FIG. 1; and the entry channel width (C), shown as reference number 11 in FIG. 2.

Figure 1:
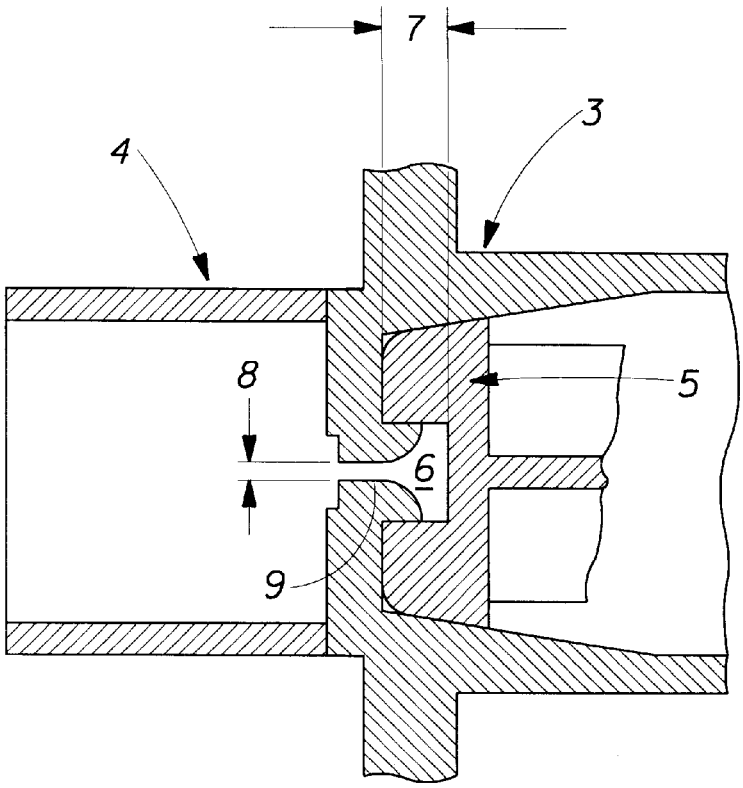
Figure 2:
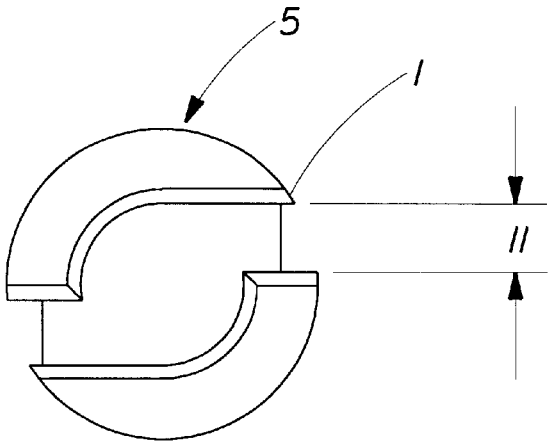

DETAILED DESCRIPTION OF THE INVENTION (a) The Detergent Surfactants

Detergent surfactants that are used in hard surface cleaner compositions include anionic, nonionic, amphoteric (including zwitterionic), and cationic detergent surfactants and mixtures thereof. Suitable detergents are well known in the art and include those described in U.S. Pat. No. 4,111,854, Spadini et al., issued Sep. 5, 1978; U.S. Pat. No. 4,424,408, Imamura et al., issued Jan. 27, 1981; U.S. Pat. No. 4,414,128, Goffinet, issued Nov. 8, 1983; U.S. Pat. No. 4,612,135, Wenzel, issued Sep. 16, 1986; U.S. Pat. No. 4,743,395, Leifheit, issued May 10, 1988; U.S. Pat. No. 4,749,509, Kacher, issued Jun. 7, 1988; U.S. Pat. No. 4,759,867, Choy et al., issued Jul. 26, 1988; U.S. Pat. No. 4,769,172, Siklosi, issued Sep. 6, 1988; U.S. Pat. No. 4,804,491, Choy et al., issued Feb. 14, 1989; and U.S. Pat. No. 4,895,669, Choy et al., issued Jan. 23, 1990, all of said patents being incorporated herein by reference.

The preferred compositions described herein before contain mixtures of nonionic and zwitterionic detergent surfactants which provide superior cleaning on all of the soils found in a bathroom, including oily/greasy soils and hard water soap scum. The combination of the two types of detergent surfactants provides good performance for all of the common types of soil encountered in the bathroom.

Amphoteric and Zwitterionic Detergent Surfactants

Amphoteric detergent surfactants are those that have either an anionic group, a cationic group, or both, depending upon the pH, and zwitterionic detergent surfactants contain both groups on the same molecule at a relatively wide range of pH's. The typical cationic group is an amine or quaternary ammonium group (for zwitterionic detergent surfactants), although other positively charged groups like sulfonium and phosphonium groups can also be used. The typical anionic hydrophilic groups are carboxylates and sulfonates, although other groups like sulfates, phosphates, etc., can be used. A generic formula for some preferred amphoteric (and zwitterionic) detergent surfactants is:

$$R—N^{(+)}(R^2)(R^3)R^4X^{(-)}$$

wherein R is a hydrophobic group; $R^2$ and $R^3$ are each hydrogen (not for zwitterionics) or, $C_{1-4}$ alkyl, hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from about one to about eight (preferably no more than about four) carbon atoms; and X is the hydrophilic group which is preferably a carboxylate or sulfonate group.

Preferred hydrophobic groups R are alkyl groups containing from about 8 to about 22, preferably less than about 18, more preferably less than about 16, carbon atoms. The hydrophobic group can contain unsaturation and/or substituents and/or linking groups such as aryl groups, amido groups, ester groups, etc.

A specific "simple" zwitterionic detergent surfactant is 3-(N-dodecyl-N,N-dimethyl)-2-hydroxy-propane-1-sulfonate, available from the Sherex Company under the trade name "Varion® HC'.

Other specific amphoteric detergent surfactants have the generic formula:

$$R—C(O)—N(R^2)—(CR^3{}_2)_n—N(R^2)_2{}^{(+)}—(CR^3{}_2)_n—SO_3{}^{(-)}$$

wherein each R is a hydrocarbon, e.g., said preferred hydrophobic groups, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups. The $R^2$ groups can also be connected to form ring structures. A zwitterionic detergent surfactant of this type is a $C_{10-14}$ fatty acylamidopropylene(hydroxypropylene) sulfobetaine that is available from the Sherex Company under the trade name "Varion® CAS Sulfobetaine."

Compositions of this invention containing the above hydrocarbyl amido sulfobetaine (HASB) can contain more perfume and/or more hydrophobic perfumes than similar compositions containing conventional anionic detergent surfactants.

Other zwitterionic detergent surfactants useful herein include hydrocarbyl, e.g., fatty, amidoalkylenebetaines (hereinafter also referred to as "HAB"). These detergent surfactants have the generic formula:

$$R—C(O)—N(R^2)—(CR^3{}_2)_n—N(R^2)_2{}^{(+)}—(CR^3{}_2)_n—C(O)O(-)$$

wherein each R is a hydrocarbon, e.g., an alkyl group containing from about 8 up to about 20, preferably up to about 18, more preferably up to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups.

An example of such a detergent surfactant is a $C_{10-14}$ fatty acylamidopropylenebetaine available from the Miranol Company under the trade name "Mirataine® BD".

The level of amphoteric, preferably zwitterionic, detergent surfactant in the composition is typically from about 0.01% to about 8%, preferably from about 1% to about 6%, more preferably from about 2% to about 4%. The level in the composition is dependent on the eventual level of dilution to make the wash solution. For cleaning, the composition, when used full strength, or the wash solution containing the composition, should contain from about 0.01% to about 8%, preferably from about 1% to about 6%, more preferably from about 2% to about 4%, of the amphoteric/zwitterionic detergent surfactant. Concentrated products will typically contain from about 0.02% to about 16%, preferably from about 4% to about 8% of the amphoteric/zwitterionic detergent surfactant.

Nonionic Detergent Surfactant

Compositions of this invention can also contain nonionic detergent surfactant (also "cosurfactant" herein for the preferred mixtures of detergent surfactants in the preferred compositions) to provide cleaning and emulsifying benefits over a wide range of soils. Nonionic surfactants useful herein include any of the well-known nonionic detergent surfactants that have an HLB of from about 6 to about 18, preferably from about 8 to about 16, more preferably from about 10 to about 14. Typical of these are alkoxylated (especially ethoxylated) alcohols and alkyl phenols, and the like, which are well-known from the detergency art. In general, such non-ionic detergent surfactants contain an alkyl group in the $C_{8-22}$, preferably $C_{10-18}$, more preferably $C_{10-16}$, range and generally contain from about 2.5 to about 12, preferably from about 4 to about 10, more preferably from about 5 to about 8, ethylene oxide groups, to give an HLB of from about 8 to about 16, preferably from about 10 to about 14. Ethoxylated alcohols are especially preferred in the compositions of the present type.

Specific examples of nonionic detergent surfactants useful herein include decyl polyethoxylate(2.5); coconut alkyl polyethoxylate(6.5); and decyl polyethoxylate(6).

A detailed listing of suitable nonionic surfactants, of the above types, for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

The nonionic cosurfactant component in the preferred compositions herein, can comprise as little as 0.01% of said preferred compositions, but typically said preferred compositions will contain from about 0.5% to about 6%, more preferably from about 1% to about 4%, of nonionic cosurfactant. The ratio of nonionic cosurfactant to zwitterionic detergent surfactant in said preferred compositions should be from about 1:4 to about 3:1, preferably from about 1:3 to about 2:1, more preferably from about 1:2 to about 1:1.

Anionic Detergent Surfactant

Typical anionic detergent surfactants are the alkyl- and alkylethoxylate-(polyethoxylate) sulfates, paraffin sulfonates, olefin sulfonates, alpha-sulfonates of fatty acids and of fatty acid esters, and the like, which are well known from the detergency art. In general, such detergent surfactants contain an alkyl group in the $C_{9-22}$, preferably $C_{10-18}$, more preferably $C_{12-16}$, range. The anionic detergent surfactants can be used in the form of their sodium, potassium or alkanolammonium, e.g., triethanolammonium salts. $C_{12-18}$ paraffin-sulfonates and alkyl sulfates are especially preferred in the compositions of the present type.

A detailed listing of suitable anionic detergent surfactants, of the above types, for the detergent compositions herein can be found in U.S. Pat. No. 4,557,853, Collins, issued Dec. 10, 1985, incorporated by reference herein before. Commercial sources of such surfactants can be found in McCutcheon's EMULSIFIERS AND DETERGENTS, North American Edition, 1984, McCutcheon Division, MC Publishing Company, also incorporated hereinbefore by reference.

In the preferred compositions described herein before, said anionic detergent cosurfactant component is optional and can comprise as little as 0.001% of said preferred compositions herein when it is present, but typically said preferred compositions will contain from about 0.01% to about 5%, more preferably from about 0.02% to about 2%, of anionic detergent cosurfactant, when it is present. Anionic detergent surfactants are desirably not present, or are present only in limited amounts in said preferred compositions to promote rinsing of the surfaces.

Cationic Detergent Surfactants

Cationic detergent surfactants useful herein are typically quaternary ammonium detergent surfactants containing one long hydrophobic group (R) and three short chain groups ($R^2$, but not hydrogen) as disclosed herein before for the zwitterionic detergent surfactant. The anion for the cationic detergent surfactant is typically a halide, preferably chloride, methyl sulfate, nitrate, or mixtures thereof.

The total detergent surfactant level is typically from about 0.1% to about 20%, preferably from about 0.5% to about 10%, more preferably from about 1% to about 5%, especially hard surface cleaning compositions.

(b) The Optional Hydrophobic Solvent

In order to obtain good cleaning, especially of lipid soils, The said preferred compositions and other compositions for use on hard surfaces, especially compositions that do not contain detergent builders, should contain hydrophobic solvent that has cleaning activity. The solvents employed in the hard surface cleaning compositions herein can be any of the well-known "degreasing" solvents commonly used in, for example, the dry cleaning industry, in the hard surface cleaner industry and the metalworking industry. The level of hydrophobic solvent is typically from about 1% to about 15%, preferably from about 2% to about 12%, most preferably from about 4% to about 10%.

Many of such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of solvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, the glycol ethers useful herein have the formula $R^1O—(R^2O—)_mH$ wherein each $R^1$ is an alkyl group which contains from about 4 to about 8 carbon atoms, each $R^2$ is either ethylene or propylene, and m is a number from 1 to about 3, and the compound has a solubility in water of less than about 20%, preferably less than about 10%, and more preferably less than about 6%. The most preferred glycol ethers are selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

The butoxy-propanol solvent should have no more than about 20%, preferably no more than about 10%, more preferably no more than about 7%, of the secondary isomer in which the butoxy group is attached to the secondary atom of the propanol for improved odor.

A preferred level of butoxy-propanol solvent for improved stability is from bout 4% to about 7%.

A particularly preferred type of solvent for these hard surface cleaner compositions comprises diols having from 6 to about 16 carbon atoms in their molecular structure. Preferred diol solvents have a solubility in water of from about 0.1 to about 20 g/100 g of water at 20° C.

The diol solvents are especially preferred because, in addition to good grease cutting ability, they impart to the compositions an enhanced ability to remove calcium soap soils from surfaces such as bathtub and shower stall walls. These soils are particularly difficult to remove, especially for compositions which do not contain an abrasive. The diols containing 8–12 carbon atoms are preferred. The most preferred diol solvent is 2,2,4-trimethyl-1,3-pentanediol.

Other solvents such as benzyl alcohol, n-hexanol, and phthalic acid esters of $C_{1-4}$ alcohols can also be used.

Terpene solvents and pine oil, are usable, but are preferably not present.

(c) The Optional Polycarboxylate Detergent Builder

Polycarboxylate detergent builders useful herein, especially in the said preferred compositions, include the builders disclosed in U.S. Pat. No. 4,915,854, Mao et al., issued Apr. 10, 1990, said patent being incorporated herein by reference. Suitable detergent builders preferably have relatively strong binding constants for calcium under acid conditions. Preferred detergent builders include citric acid, and, especially, builders having the generic formula:

$$R^5—[O—CH(COOH)CH(COOH)]_nR^5$$

wherein each $R^5$ is selected from the group consisting of H and OH and n is a number from about 2 to about 3 on the average. Citric acid at a level of from about 3% to about 6% is preferred for stability reasons. Other preferred detergent builders include those described in the copending U.S. patent application Ser. No. 285,337 of Stephen Culshaw and Eddy Vos for "Hard-Surface Cleaning Compositions," filed Dec. 14, 1988, said patent application being incorporated herein by reference.

In addition to the above detergent builders, other detergent builders that are relatively efficient for hard surface cleaners and/or, preferably, have relatively reduced filming/streaking characteristics include the acid forms of those disclosed in U.S. Pat. No. 4,769,172, Siklosi, issued Sep. 6, 1988, and incorporated herein by reference. Still others include the chelating agents having the formula:

$$R—N(CH_2COOM)_2$$

wherein R is selected from the group consisting of: $—CH_2CH_2CH_2OH$; $—CH_2CH(OH)CH_3$; $—CH_2CH(OH)CH_2OH$; $—CH(CH_2OH)_2$; $—CH_3$; $—CH_2CH_2OCH_3$; $—C(O)—CH_3$; $—CH_2—C(O)—NH_2$; $—CH_2CH_2CH_2OCH_3$; $—C(CH_2OH)_3$; and mixtures thereof; and each M is hydrogen.

Chemical names of the acid form of the chelating agents herein include:

N(3-hydroxypropyl)imino-N,N-diacetic acid (3-HPIDA);
N(-2-hydroxypropyl)imino-N,N-diacetic acid (2-HPIDA);

N-glycerylimino-N,N-diacetic acid (GLIDA);
dihydroxyisopropylimino-(N,N)-diacetic acid (DHPIDA);
methylimino-(N,N)-diacetic acid (MIDA);
2-methoxyethylimino-(N,N)-diacetic acid (MEIDA);
amidoiminodiacetic acid (also known as sodium amidonitrilotriacetic, SAND);
acetamidoiminodiacetic acid (AIDA);
3-methoxypropylimino-N,N-diacetic acid (MEPIDA); and
tris(hydroxymethyl)methylimino-N,N-diacetic acid (TRIDA).

Methods of preparation of the iminodiacetic derivatives herein are disclosed in the following publications:

Japanese Laid Open publication 59-70652, for 3-HPIDA;

DE-OS-25 42 708, for 2-HPIDA and DHPIDA;

Chem. ZVESTI 34(1) p. 93–103 (1980), Mayer, Riecanska et al., publication of Mar. 26, 1979, for GLIDA;

C.A. 104(6)45062 d for MIDA; and

Biochemistry 5, p. 467 (1966) for AIDA.

The chelating agents of the invention are preferably present at levels of from about 2% to about 14% of the total composition, more preferably from about 3% to about 12%, even more preferably from about 5% to about 10%.

(d) The Polymeric Shear-Thinning Thickener

Compositions which are inherently shear-thinning and pseudoplastic can be used without modification. However, most hard surface cleaning compositions contain relatively low (less than about 10%) detergent surfactant and have viscosities of less than about 15 cps. Accordingly, a very slight amount of thickener is usually required to reduce the number of very small particles (less than 10 micron diameter) that an acidic product can produce. These small particles tend to cause irritation upon inhalation into the nose, throat, and lungs. Addition of a polymer can increase the viscosity, but preferably maintaining it below about 30 cps, preferably below about 25 cps.

The polymeric shear-thinning thickener can be any of the shear-thinning thickeners known in the art to thicken liquid compositions and especially aqueous compositions. Substituted cellulose materials, e.g., carboxymethylcellulose, hydroxymethylcellulose, etc., and naturally occurring thickeners like carrageenan and xanthan gum are useful herein. Xanthan gum is the preferred thickener. Xanthan gum is disclosed in U.S. Pat. No. 4,788,006, Bolich, issued Nov. 29, 1986, at Col. 5, line 55 through Col. 6, line 2, said patent being incorporated herein by reference.

Hard surface detergent compositions and especially the preferred detergent compositions described herein before can be thickened by a process in which the thickener is added, preferably in fully hydrated form, at a level of from about 0% to about 0.05%, preferably from about 0.001% to about 0.035%, more preferably from about 0.005% to about 0.025%, to raise the viscosity of a composition whose viscosity is less than about 0 cps to from about 10 to about 30, preferably from about to about 20 cps. If the viscosity is too high, a visible foam results and at even the slightly higher viscosities, the area covered by the foam spray pattern starts to decrease substantially. The viscosity is adjusted to provide a content of particles having a particle size of less than about 10 microns that is less than about 4 $mg/m^3$, preferably less than about 3.5 $mg/m^3$, and more preferably less than about 3 $mg/m^3$, as measured by a gravimetric cascade impactor device made by California Measurements, Inc., 150 East Montecito Ave., Sierra Madre, Calif. (Flow rate through the 10 stage crystal-micro balance cascade impactor is about 0.24 liters per minute flow.) The foam/liquid volume ratio is less than about 2/1, preferably less than about 1.8/1, and even more preferably $\leqq 1.7/1$. The low content of foam apparently is a signal to some consumers that the product is less "sudsy" and more easily rinsed. This invention thus provides most of the benefits of a "foam" product without any of the perceived "negatives" in the minds of these consumers.

The viscosity is determined using a Brookfield Synchro-electric Viscometer, model LVT®, made by Brookfield Engineering Laboratory, Inc., Stoughton, Mass., using a No. 1 spindle at 60 rpm, and at a temperature of about 20° C. (Constant shear rate of about 13 inverse seconds.)

Shear-thinning characteristics of, e.g., polymers and/or compositions, are determined using a Carrimed Controlled Stress Rheometer Model CSL 100®, made by Carrimed Ltd., Interpret House, Curtis Road Estate, Dorking, Surry RH 4 1DP, England. The Rheometer employs double concentric cylinders geometry to make steady shear measurements at various shear rates. These measurements are made at about 26° C. The shear-thinning, pseudo plastic behavior of the xanthan gum system an be mathematically modeled by the equation:

$$N=KR^{n-1}$$

where N is the apparent viscosity, K is the consistency constant, R is the shear rate, and n is the shear index. For best spraying results (dispensing) the values of K and n should give viscosities below 15 cps at spraying shear rates (~10,000 inverse seconds, as reported in trade literature).

Shear-thinning behavior is described in U.S. Pat. No. 4,783,283, Stoddart, issued Nov. 8, 1988, especially the portion appearing at column 2, line 46, et seq.

(e) The Aqueous Solvent System

The balance of the formula is typically water. Non aqueous polar solvents with only minimal cleaning action like methanol, ethanol, isopropanol, ethylene glycol, propylene glycol, and mixtures thereof are usually not present. When the non aqueous polar solvent is present, the level of non aqueous polar solvent is from about 0.5% to about 10%, preferably less than about 5%, and the level of water is from about 50% to about 97%, preferably from about 75% to about 95%.

(f) The Optional Ingredients

The compositions herein can also contain other various adjuncts which are known to the art for detergent compositions so long as they are not used at levels that cause unacceptable spotting/filming.

Buffering materials are especially desirable optional ingredients. Although the acidic detergent builders herein will normally provide the desired acid pH, the composition can also contain additional buffering materials to give a pH in use of from about 1 to about 13, preferably from about 1 to about 5.5, more preferably from about 2 to about 4.5, and even more preferably from about 3 to about 4.5. pH is usually measured on the product. The buffer is selected from the group consisting of mineral acids such as HCl, $HNO_3$, etc., and organic acids such as acetic, succinic, tartaric, etc., and mixtures thereof. The buffering material in the system is important for spotting/filming. Preferably, the compositions are substantially, or completely free of materials like oxalic acid that are typically used to provide cleaning, but which are not desirable from a safety standpoint in compositions that are to be used in the home, especially when very young children are present.

Non limiting examples of other such adjuncts are:

Enzymes such as proteases;

Hydrotropes such as sodium toluene sulfonate, sodium cumene sulfonate and potassium xylene sulfonate; and Aesthetic-enhancing ingredients such as colorants and perfumes, providing they do not adversely impact on spotting/filming in the cleaning of glass. The perfumes are preferably those that are more water-soluble and/or volatile to minimize spotting and filming.

Perfumes

Most hard surface cleaner products contain some perfume to provide an olfactory aesthetic benefit and to cover any "chemical" odor that the product may have.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. No. 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979, all of said patents being incorporated herein by reference.

Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Selection of any particular perfume ingredient is primarily dictated by aesthetic considerations, but more water-soluble materials are preferred, as stated herein before, since such materials are less likely to adversely affect the good spotting/-filming properties of the compositions.

Sodium cumene sulfonate at a level of from about 2% to about 4% is preferred as a hydrotrope for optimum stability.

(g) The Spray Means

The compositions herein are used by placing them in a spray package comprising a non-aerosol spray device "spray means." Said spray means is any of the manually activated, preferably "trigger-type," means for producing a spray of liquid droplets as is known in the art. Typical spray means are disclosed in U.S. Pat. No. 5,294,025, Foster, issued March 15, 1994; U.S. Pat. No. 4,082,223, Nozawa, issued Apr. 4, 1978; U.S. Pat. No. 4,161,288, McKinney, issued Jul. 17, 1979; U.S. Pat. No. 4,558,821, Tada et al., issued Dec. 17, 1985; U.S. Pat. No. 4,434,917, Saito et al., issued Mar. 6, 1984; and U.S. Pat. No. 4,819,835, Tasaki, issued Apr. 11, 1989, all of said patents being incorporated herein by reference. The spray bottle, or container can be any of the ones commonly used for containing hard surface cleaner detergent compositions. Examples of bottles are those in U.S. Design Pat. No. 244,991, Weekman et al., issued Jul. 12, 1977; and U.S. Design Pat. No. 275,078, Wassergord et al., issued Aug. 14, 1984, said patents being incorporated herein by reference.

The spray means herein do not include those that incorporate a propellant gas into the liquid. However, if a device can be adjusted to either give a non-foaming liquid spray or a foam, said device is included herein only when it is adjusted to give a non-foaming liquid spray. The spray means herein are typically those that act upon a discrete amount of the composition itself, typically by means of a piston that displaces the composition and expels the composition through a nozzle to create a spray of thin liquid. Surprisingly, it has been found that a very slightly thickened, shear-thinning, pseudoplastic aqueous hard surface detergent composition, when expelled through such a means, will form a pattern without foam that has an area that is similar to, or only slightly smaller than, the liquid spray, and with significantly less small particle aerosolization which leads to irritation when inhaled. Preferably the volume of suds/foam (and any liquid) that is dispensed is less than about twice, more preferably less than about 1.8, and even more preferably less than, or equal to, 1.7 times, the volume of the product dispensed. The very slight level of thickener acts to decrease the amount of small particles when sprayed and, on vertical surfaces acts to delay the descent of the composition (increased cling time). The additional cling time provides improved cleaning and/or ease of cleaning.

In a preferred process for using the products described herein, and especially those formulated to be used at full strength, the product is sprayed onto the surface to be cleaned and then wiped off with a suitable material like cloth, sponge, a paper towel, etc. Surprisingly, the compositions and processes described herein provide effective disinfectancy.

Preferred slightly thickened, stable, shear-thinning, pseudoplastic liquid detergent composition consists essentially of from about 1% to about 3% by weight of the composition of 3-(N-dodecyl-N,N-dimethyl)-2-hydroxypropane-1-sulfonate; from about 1% to about 3% by weight of the composition of decyl polyethoxylate (6); from about 5% to about 7% by weight of the composition of butoxy propoxy propanol; from about 3% to about 6% by weight of the composition of citric acid; from about 0.01% to 0.035% by weight of the composition of xanthan gum; from about 3% to about 4% by weight of the composition of sodium cumene sulfonate; and the balance being water and buffering agents.

All parts, percentages, and ratios herein are "by weight" unless otherwise stated. All number values are approximate unless otherwise stated. All references herein, in pertinent part, are incorporated by reference.

The invention is illustrated by the following Examples.

EXAMPLE I

| Ingredient | Weight % |
|---|---|
| 3-(N-dodecyl-N,N-dimethyl)-2-hydroxy-propane-1-sulfonate (DDHPS) | 2.0 |
| Decyl polyethoxylate (6.0) (DEP6) | 2.0 |
| Butoxy Propoxy Propanol (BPP) | 8.0 |
| Citric Acid | 6.0 |
| Xanthan Gum | As indicated |
| Sodium Cumene Sulfonate (SCS) | 3.0 |
| Water, Buffering Agents, and Minors | up to 100 |
| pH = 3.0 | |

*The xanthan gum is Keltrol ®, sold by Kelco, a Division of Merck & Co., Inc.

The above generic formula is prepared as two separate specific formulas A and B with different levels of xanthan gum.

Formula A contains no xanthan gum, Formula B contains about 0.025% xanthan gum. Formula A has a viscosity of about 5 cps and Formulas B is shear-thinning, pseudoplastic compositions having viscosities of about 15 cps. When the compositions are sprayed through the trigger-type sprayer used by the commercial product CINCH®, the maximum effort in in-lbs/ml required for dispensing A and B, are all essentially the same and about 4 in-lbs/ml.

When the formulas are sprayed through the same CINCH trigger-type sprayer, the areas of the resulting generally circular spray patterns are roughly equivalent.

The "cling" time for A is about 2.8 seconds, and the cling times for B is significantly greater. This difference in cling time is substantial and gives composition B more time to soften soil deposits which in turn results in B providing easier and/or more complete removal of typical bathroom soils. The patterns for B also remains much more uniform on vertical surfaces than the pattern for A. Formula A and B are dispensed as a liquid. Formulas A and B both gave suds/foam of less than 1.7 times the volume of the liquid dispensed.

The specific configuration of the nozzle components, that define the geometry of the pressure swirl atomizer, can also effect the amount of visible foam and the amount of small particles produced in the spray that contribute to consumer discomfort. Options 1 through 5 describe configurations of the nozzle components, the nozzle being the one found in the FIGURE, having the dimensions as set forth below, and their effect on visible foam and the amount of small particles produced.

| Option | O | L | D | C | Impingement tube | Formula | Detected Particles 24 to 0.14 micron (mg/m$^3$) | Pattern Diameter @ 12" | Foam to liquid ml/ml |
|---|---|---|---|---|---|---|---|---|---|
| 1 | 0.023" | 0.024" | 0.026" | 0.031" | no | A | t.b.d. | 8.0" | 1.5 |
| 2 | 0.023" | 0.024" | 0.026" | 0.031" | no | B | t.b.d. | 7.0" | 2.0 |
| 3 | 0.028" | 0.075" | 0.051" | 0.0425" | no | B | 3.098 mg/m3 | 7.0" | 1.5 |
| 4 | 0.028" | 0.075" | 0.051" | 0.047" | no | B | 2.1038 mg/m3 | 7.0" | 1.7 |
| 5 | 0.028" | 0.069" | 0.051" | 0.0425" | yes | A | 1.5770 mg/m3 | 8.5" | 3.0 |

The small particles are detected and the amount measured using a gravimetric cascade impactor device model PC-2 made by California Measurements, Inc., 150 East Montecito Ave., Sierra Madre, Calif. Product was sprayed through each sprayer into an enclosure with an automatic mechanical actuator at the rate of 120 sprays per minute, which is sufficient to saturate the airspace of the enclosure with aerosolized product. The aerosolized sample is drawn from the enclosure through the instrument at a flow rate of about 0.24 liters per minute and is exposed to a 10 stage crystal-micro balance cascade impactor for about 40 seconds. Readings of the mass of product in the 0.14 to 24 micron range are taken at 90 seconds and 150 seconds and averaged. The amount of small particles and the types of materials in the particles affect the level of discomfort experienced by the spray device user. Lowering the gm/m$^3$ of small particles in a given volume of air results in reduced exposure to potentially respirable particles. Option 2 with xanthan gum in the composition, when used in the same spray device as option 1, produces a lesser amount of small particles, as the xanthan gum thickener increases the cohesive force between particles. Further, the combination of xanthan gum and unique combinations of nozzle configurations can further reduce the amount of small particles as shown by the comparison of options 3 and 4. The increase in orifice diameter (O) effects a reduction in axial velocity of the spray particles. The increases in both swirl chamber depth (D) and entry channel width (C) increase the effective entry port size and effect a lower radial velocity. This particular spray configuration, along with an increase in orifice land depth (L) decreases the relative dispersion velocity of the mist, helping the particles cohere. The amount of small particles can also be reduced using an impingement tube foamer tip (as described in U.S. Pat. No. 5,158,233, Foster et al.). However, this approach is less desirable since it produces twice as much, or more, visible foam as options 1 and 3.

Formula B, having a viscosity of 15 cps, has shear-thinning pseudoplastic behavior expressed, using the formula given herein before, by: $N=166.1\ R^{-0.44}$. At a spraying shear rate of 10,000 inverse seconds, the theoretical viscosity is about 3 cps, which provides good spray properties. The composition almost immediately reverts to the higher viscosity after spraying to provide good cling time.

EXAMPLE II

| Ingredient | Weight % |
|---|---|
| DDHPS | 2.0 |
| DPE6 | 2.0 |
| BPP | 8.0 |
| Oxydisuccinic Acid (ODS) | 6.0 |
| Xanthan Gum | 0.025 |
| SCS | 1.6 |
| Water, Buffering Agents, and Minors pH = 3.0 | up to 100 |

EXAMPLE III

A liquid hard surface cleaner composition is prepared according to the following formula:

| Ingredient | Weight % |
|---|---|
| DDHPS | 2.0 |
| ODS | 10.0 |
| DPE6 | 2.0 |
| BPP | 6.0 |
| Xanthan Gum | 0.025 |
| SCS | 7.5 |
| Water, Buffering Agents, and Minors pH = 4.5 | up to 100 |

EXAMPLE IV

| Ingredient | Weight % |
|---|---|
| 3-(N-cetyl-N,N-dimethyl)-propane-1-sulfonate | 2.0 |
| Decyl polyethoxylate (2.5) | 1.1 |
| DPE6 | 2.9 |

-continued

| Ingredient | Weight % |
|---|---|
| ODS | 10.0 |
| Hydroxyethylcellulose (D.S. ~1) | 0.05 |
| BPP | 5.0 |
| Water, Buffering Agents, and Minors pH = 1 | up to 100 |

EXAMPLE V

Aqueous compositions containing anionic detergent surfactant (sodium coconut alkyl sulfate), nonionic detergent surfactant [$C_{9-11}$ alkyl polyethoxylate (6)], and zwitterionic detergent surfactant (Varion CAS Sulfobetaine®), respectively at levels of 0.05, 0.5, and 8%, are prepared with the addition of about 0.11% xanthan gum and dispensed through the commercial trigger-type spray device used with the commercial product CINCH®. All of the compositions are dispensed as visible foams.

EXAMPLE VI

Compositions with the following ranges of ingredients are exceptionally stable at temperatures of from about 40° F. to about 120° F. By balancing the hydrophobic and hydrophilic ingredients one can avoid separation of the xanthan gum at higher temperatures.

| Ingredient Range | Weight % |
|---|---|
| Zwitterionic Detergent | 1–3 |
| Nonionic Detergent | 1–3 |
| Hydrophobic Solvent | 5–7 |
| Citric Acid | 3–6 |
| Xanthan Gum | 0.1–0.15 |
| Sodium Cumene Sulfonate | 3–4 |
| Water, Buffering Agents, and Minors pH = ~3 | up to 100 |

| Specific Ingredient | Weight % |
|---|---|
| DDHPS | 2.0 |
| DPE6 | 2.0 |
| BPP | 6.0 |
| Citric Acid | 4.5 |
| Xanthan Gum | 0.11 |
| Sodium Cumene Sulfonate | 3.5 |
| Water, Buffering Agents, and Minors pH = ~3 | up to 100 |

This formula provides effective disinfectancy.

What is claimed is:

1. Article of manufacture comprising very lightly thickened, shear-thinning, pseudoplastic liquid detergent composition having a viscosity in the range of from 15 to about 30 cps, packaged in a non-aerosol spray device that produces a liquid spray, said composition being dispensed without a visible foam having a foam/liquid volume ratio of less than about 2/1 and wherein said composition either (1) comprises from about 0.001% to about 0.05% by weight of the composition of polymeric shear-thinning thickener or (2) the pH of said composition is from about 1 to about 5.5, or the composition has both (1) and (2).

2. The article of manufacture of claim 1 wherein said spray device is a trigger spray device that produces no visible foam and less than about 4 mg/m$^3$ of liquid particles with a diameter of less than about 10 microns.

3. The article of manufacture of claim 1 wherein said polymeric shear-thinning thickener is present at a level of from about 0.001% to about 0.035% by weight of the composition.

4. The article of manufacture of claim 3 wherein said polymeric shear-thinning thickener is present at a level of from about 0.005% to about 0.025% by weight of the composition.

5. The article of manufacture of claim 1 which dispenses a foam/liquid volume ratio of less than about 2/1 and less than about 4 mg/m$^3$ of liquid particles with a diameter of less than about 10 microns.

6. Slightly thickened, shear-thinning, pseudoplastic liquid detergent composition containing from about 0.1% to about 20% by weight of the composition of detergent surfactant, and having a viscosity in the range of from 15 to about 25 cps and a pH of from about 1 to about 13, said composition being dispensed without a visible foam having a foam/liquid volume ratio of less than about 2/1, said composition comprising from about 0.001% to about 0.05% by weight of the composition of polymeric shear-thinning thickener.

7. The composition of claim 1 wherein said composition comprises from about 0.001% to about 0.035% by weight of the composition of polymeric shear-thinning thickener.

8. The composition of claim 7 wherein said polymeric shear-thinning thickener is present at a level of from about 0.005% to about 0.025% by weight of the composition.

9. The composition of claim 7 which is an acidic aqueous hard surface detergent composition comprising: (a) mixture of zwitterionic and nonionic detergent surfactants; (b) hydrophobic solvent that provides a cleaning function; (c) polycarboxylate detergent builder; and (d) the balance being an aqueous solvent system, the pH of said composition being from about 1 to about 5.5.

10. The composition of claim 9 wherein said zwitterionic detergent surfactant has the formula:

$$R—N^{(+)}(R^2)(R^3)R^4X^{(-)}$$

wherein R is a hydrophobic group; $R^2$ and $R^3$ are each $C_{1-4}$ alkyl, hydroxy alkyl or other substituted alkyl group which can also be joined to form ring structures with the N; $R^4$ is a moiety joining the cationic nitrogen atom to the hydrophilic group and is an alkylene, hydroxy alkylene, or polyalkoxy group containing from about 1 to about 4 carbon atoms; and X is the hydrophilic group which is a carboxylate or sulfonate group.

11. The composition of claim 10 containing sufficient buffering material to maintain a pH of from about 2 to about 4.5.

12. The composition of claim 11 wherein said nonionic detergent surfactant has an HLB of from about 10 to about 14.

13. The composition of claim 12 containing from about 1% to about 15% by weight of the composition of said solvent (b), said solvent being selected from the group consisting of alkyl and cycloalkyl hydrocarbons and halohydrocarbons, alpha olefins, benzyl alcohol, glycol ethers, and diols containing 6 to 16 carbon atoms.

14. The composition of claim 13 wherein said solvent (b) has the formula $R^1O—(R^7O—)_mH$ wherein each $R^1$ is an alkyl group which contains from about 4 to about 8 carbon atoms, each $R^7$ is selected from the group consisting of ethylene and propylene, and m is a number from 1 to about 3.

15. The composition of claim 13 wherein said solvent (b) is selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

16. The composition of claim 12 wherein said zwitterionic detergent surfactant is a hydrocarbylamidoalkylenesulfobetaine having the formula:

$$R—C(O)—N(R^5)—(CR^6{}_2)_n—N(R^5)_2{}^{(+)}—(CR^6{}_2)_n—S(O)_3{}^{(-)}$$

wherein each R is an alkyl group containing from about 10 to about 18 carbon atoms, each ($R^5$) is selected from the group consisting of methyl, ethyl, propyl, hydroxy substituted ethyl or propyl and mixtures thereof, each ($R^6$) is selected from the group consisting of hydrogen and hydroxy groups, and each n is a number from 1 to about 4; with no more than about one hydroxy group in any ($CR^6_2$) moiety.

17. The composition of claim 16 wherein said nonionic detergent surfactant has an HLB of from about 10 to about 14.

18. The composition of claim 17 containing sufficient buffering material to maintain a pH of from about 2 to about 4.5.

19. The composition of claim 18 containing from about 1% to about 15% by weight of the composition of solvent (b) having the formula $R^1O—(R^7O—)_mH$ wherein each $R^1$ is an alkyl group which contains from about 4 to about 8 carbon atoms, each $R^7$ is selected from the group consisting of ethylene and propylene, and m is a number from 1 to about 3.

20. The composition of claim 12 wherein the level of said zwitterionic detergent surfactant is from about 0.01% to about 8% by weight of the composition; the level of said nonionic detergent surfactant is from about 0.01% to about 6% by weight of the composition; the ratio of said nonionic to said zwitterionic detergent surfactant is from about 1:4 to about 3:1; the level of said hydrophobic solvent is from about 1% to about 15% by weight of the composition; the level of said polycarboxylate detergent builder is from about 2% to about 14% by weight of the composition; and the pH of said composition is from about 2 to about 4.5.

21. The composition of claim 20 wherein the level of said zwitterionic detergent surfactant is from about 1% to about 6% by weight of the composition; the level of said nonionic detergent surfactant is from about 0.5% to about 6% by weight of the composition; the ratio of said nonionic to said zwitterionic detergent surfactant is from about 1:3 to about 2:1; the level of said hydrophobic solvent is from about 2% to about 12% by weight of the composition; the level of said polycarboxylate detergent builder is from about 3% to about 12% by weight of the composition; and the pH of said composition is from about 2 to about 4.5.

22. Slightly thickened, stable, shear-thinning, pseudoplastic liquid detergent composition consisting essentially of: from about 1% to about 3% by weight of the composition of 3-(N-dodecyl-N,N-dimethyl)-2-hydroxypropane-1-sulfonate; from about 1% to about 3% by weight of the composition of decyl polyethoxylate (6); from about 5% to about 7% by weight of the composition of butoxy propoxy propanol; from about 3% to about 6% by weight of the composition of citric acid; from about 0.01% to 0.035% by weight of the composition of xanthan gum; from about 3% to about 4% by weight of the composition of sodium cumene sulfonate; and the balance being water and buffering agents.

* * * * *